United States Patent [19]

Damin et al.

[11] Patent Number: 4,834,892

[45] Date of Patent: May 30, 1989

[54] ADDITIVES FOR LUBRICATING OILS, THEIR PROCESS OF PREPARATION AND LUBRICATING COMPOSITIONS CONTAINING THEM

[75] Inventors: Bernard Damin, Oullins; Daniele Eber, Lyons; Pierre Hoornaert, St. Pierre de Chandieu; Claude Rey, Lyons, all of France

[73] Assignee: Elf France, Courbevoie, France

[21] Appl. No.: 210,203

[22] Filed: Jun. 20, 1988

Related U.S. Application Data

[63] Continuation of Ser. No. 915,267, Oct. 3, 1986, abandoned.

[30] Foreign Application Priority Data

Oct. 3, 1985 [FR] France ..... 85 14663

[51] Int. Cl.[4] ..... C10M 105/22

[52] U.S. Cl. ..... 252/32.7 E; 252/33.6; 252/35; 252/39; 252/515 A; 252/400.21

[58] Field of Search ..... 252/32.7 E, 33, 33.6, 252/34, 35, 39, 51.5 A, 400.21

[56] References Cited

U.S. PATENT DOCUMENTS

| | | | |
|---|---|---|---|
| Re. 26,433 | 8/1968 | Le Suer | 252/34 |
| 2,264,999 | 12/1941 | Mueselman | 252/34 |
| 2,330,524 | 9/1943 | Shields | 252/34 |
| 2,382,818 | 8/1945 | Rhodes et al. | 252/34 |
| 2,697,656 | 12/1951 | Stayner et al. | 44/72 |
| 3,945,931 | 3/1976 | Bussi et al. | 252/33.6 |
| 4,320,015 | 3/1982 | Vaughan | 252/33.6 |
| 4,375,418 | 3/1983 | Zoleski et al. | 252/32.7 E |
| 4,386,001 | 5/1983 | Zoleski et al. | 252/32.7 E |
| 4,534,873 | 8/1985 | Clark | 252/32.7 E |
| 4,592,851 | 6/1986 | Stadtmiller | 252/32.7 E |

*Primary Examiner*—Jacqueline V. Howard
*Assistant Examiner*—Margaret B. Medley
*Attorney, Agent, or Firm*—Burgess, Ryan & Wayne

[57] ABSTRACT

The present invention relates to additives for lubricating oils having an antirust and antiwear effect, their process of preparation and the lubricating compositions containing the said additives, these additives consisting in a microdispersion in the oil of the metallic salts of amino-acids, wherein the dicarboxylic amino-acids and their derivatives are advantageously used and wherein the salts are generally formed with metals from Groups I and II of the Periodic Classification of Elements.

13 Claims, No Drawings

ADDITIVES FOR LUBRICATING OILS, THEIR PROCESS OF PREPARATION AND LUBRICATING COMPOSITIONS CONTAINING THEM

This application is a continuation of application Ser. No. 915,267, filed 10/3/86 abandoned.

BACKGROUND OF THE INVENTION

1. Field of the Invention

The present invention relates to additives for lubricating oils confering antirust and antiwear effect, their method of preparation and the lubricating compositions containing the additives.

2. Description of the Prior Art

Combustibles, especially those used in fuel or heavy fuel motors contain increasingly large amounts of sulphur. At the same time, the operating conditions of these motors, defined by the compression rate and the operating temperature become increasingly stringent. In order to prevent corrosive wear by micro-seizing, the use of anti-wear lubricants able to neutralize large amounts of acids formed during combustion becomes indispensable.

The detergent and dispersant properties of a lubricant correspond to its ability to maintain in suspension the impurities and the unburned particles in the heated portions of the motor through its detergent action but also in the cold portions by its dispersant effect. The fixing of these particles in the form of varnishes or laquers is thus prevented.

The basicity reserve as well as the detergent and dispersant properties are normally conferred by overbased additives. These additives comprise alkaline-earth metal carbonates in a sulfonate, phenate or salicylate type detergent solution.

The preparation of these overbased additives is described in numerous patents.

European patent application No. 00 05357 describes a process that consists in carbonating a mixture of alkylarylsulfonate, magnesium oxide, xylene, methanol, ammonia and water.

British patent application Nos. 2,114,993 and 2,037,310, European patent application No. 0 13 807 and French Pat. No. 2,529,224 claim replacing methanol by respectively dioxolan, a mixture of ethanol and carboxylic acids, a mixture of methanol and diacetone and glycol.

French Pat. Nos. 2,445,368 and 2,454,435 describe the preparation of metallic salts of amino acids and of N-carboxyaminoacids through reaction of the acids with a basically reacting metallic compound having a basic reaction belonging to the group of the oxide or hydroxide of magnesium, of barium or of calcium, in the presence of a suspension agent soluble in the oil, such as an hydrocarbylsulfate, carboxylate, hydocarbylsuccinate of alkaline or alkaline-earth metals or an hydrocarbylsuccinimide. The reaction takes place in the presence of a hydroxylic activator such as water or an alkanol and a chalcogenic compound such as carbon dioxide.

However, although the overbased additives prevent corrosive wear due to the acids formed during combustion, they are ineffective against the abrasion provoked by the solid particles such as the unburned particles, impurities and ashes contained in the lubricant and maintained in dispersion.

In order to overcome wear, it is necessary to use antiwear additives. These additives are generally sulfur and/or phosphorus containing compounds, the most commonly used being the Zn dialkyldithiophosphates, described for example in U.S. Pat. Nos. 4,085,053; 4,094,800 and 4,101,428.

SUMMARY OF THE INVENTION

The present invention proposes an additive which combines the antirust and antiwear properties. It neutralizes the acids formed during combustion and presents an antiwear power.

The additive according to the invention consists in a microdispersion in oil of the metallic salts of the amino-acids.

What is meant by amino-acids in the present description are all organic compounds containing at least one carboxylic group and at least one primary, secondary or tertiary amine group.

The dicarboxylic amino-acids and their derivatives, such as monoesters and monoamides, are in particular most suitable.

The natural amino-acids are generally used. Among the dicarboxylic acids and their derivatives, can be cited, aspartic and glutamic acid, glutamine and asparagine. The monocarboxylic natural amino-acids such as glycine, alanine, lysine, proline, arginine, serine, cystine and cysteine are also suitable.

The salts are formed with basically reacting compounds, in general oxides or hydroxides of a metal from Group II of the Periodic Table of Elements or a hydroxide from Group I. Calcium or magnesium oxides or hydroxides are preferably used.

The oil is generally a paraffinic or naphthenic mineral oil. A diluent as for example the diluent marketed under the tradename 100 Neutral will preferably be used.

The microdispersion is prepared by forming a water-in-oil emulsion from an aqueous solution of the metallic salt and the amino-acid saturated at ambient temperature, oil and a dispersing agent.

The dispersing agents are selected from among the those classically used in lubricant and known to those skilled in the art. They are generally selected from among the group formed of succinimide, phenol derivatives, and the like.

The water present in the emulsion thus prepared is evaporated under stirring in order to form a stable microdispersion of the metallic salt of the amino-acid in the oil.

The aqueous salt solution of the amino-acid is prepared by dissolving the salt in water, provided the latter is available. The salt can however be prepared by contacting in an aqueous medium an amino-acid and a basically reacting metallic compound at a temperature comprised between about 20° and 80° C. and generally comprised between 40° and 60° C.

The microdispersions obtained are very stable. They present a milky appearance. The microcrystals are visible under the microscope.

The lubricating compositions containing a large quantity of lubricating oil and a small quantity of an additive according to the invention protect the motors against corrosion, wear and the deposit of particles in the form of varnishes or laquers.

These compositions generally contain from 1% to 30% by weight of additive and preferably from 5 to 25% by weight.

The lubricating oils utilized can be of petroleum or synthetic origin.

The oils of petroleum origin are complex mixtures of normal, iso and cycloparaffins possibly associated with small quantities of aromatic compounds.

The viscosity of these lubricating oils can vary fairly widely but it is generally comprised between 25 and 75 cSt at 40° C.

The microdispersions according to the invention can be used alone as additives to the lubricating oils but it is possible to use them in a mixture with other additives.

The lubricating compositions that contain the microdispersions and an additive from the family of dithiophosphates have excellent antiwear properties, better than those observed for the two additives used separately. This synergetic effect is that much more advantageous in that most of the basically reacting additives can be incompatible with the antiwear additives used. Among the dithiophosphate derivatives to be used can be more particularly cited the metallic dithiophosphates, especially zinc and antimony dithiophosphates and amine dithiophosphates, in particular those of aliphatic amines.

The antiwear effect of the lubricating compositions according to the invention is rendered evident by the tests performed on the FALEX machine according to the ASTM 2670 standard, by wear tests on 4 ball machines according to ASTM 2783-71 standard and by motor tests PETTER AVI according to the DEF 2101 D method.

The following examples given by way of non-limitative example are intended to illustrate the present invention.

Example 1

In a 1 liter capacity flask a 25% aqueous solution is prepared of calcium aspartate by reaction at 60° during one hour of 39.2 g (0.7 mole) calcium oxide, 182.2 g (1.4 mole) aspartic acid and 638.4 g of water.

After cooling, this solution is added to 212.8 g of a mineral oil to which has been added 20% of two dispersing agents of the succinimide and alkylphenol type. An emulsion is formed by stirring. By evaporating during one hour the water of the emulsion, composition I is obtained of which the AV (alkaline value) is 393. The alkaline value is equal to the number of milligrams of KOH per gram of additive and is determined according to the ASTM D 2896 standard.

Example 2

According to the same operating method as used in example 1, an aqueous solution at 20% is prepared of calcium aspartate by dissolving 56 g (1 mole) of calcium oxide, 133 g (1 mole) of aspartic acid and 684 g of water. After emulsifying in 171 g of an oil to which has been added 20% of dispersing agents, such as defined in Example 1 and after evaporation, is obtained composition II of which the AV is 463.

Example 3

According to the same operating method as used in Example I, composition III is prepared from 28 g (0.7 mole) magnesium oxide, 186.2 g (1.4 mole) of aspartic acid, 638.4 g of water and 212.8 g of oil to which has been added dispersion agents such as defined in example 1. The AV of composition III is 330.

Example 4

The same operating method is used to prepare composition IV from 56 g (1 mole) of calcium oxide, 150 g (2 moles) of glycine and 224 g of water than 180 g of oil to which has been added dispersing agents such as defined in example 1. After evaporation of the water, composition IV presents an AV of 354.

Example 5 (comparative)

In a 1 liter capacity flask, 150 g of a concentrate containing 67% of an alkyl aromatic sulfonate of calcium dissolved in a hydrocarbon, are made to react with 400 ml of a hydrocarbon diluent, 20 ml of methanol, 10 ml of water, 37.5 g (0.5 mole) of glycine and 25 g of calcium oxide. 25 g of carbonic anhydride are added over a period of 5 hours while maintaining the temperature at about 45° C. The mixture is filtered then distilled in order to produce a product V having an AV of 270.

Example 6

According to the operating method described for example 1, composition IV is prepared from 22.8 g (0.4 mole) of calcium oxide, 98.5 g (0.8 mole) of cysteine and 456 g of water then 186 g of oil and dispersing agents such as defined in example I. The AV of composition VI is 279.

Example 7

According to the same operating method, composition VI is synthesized from 22.3 g (0.4 mole) of calcium oxide, 105 g (0.8 mole) of lysine, 375 g of water and 180 g of oil and dispersing such as defined in example 1. The AV of composition VII is 283.

Example 8

According to the same operating method, composition VIII is prepared from 160 g (0.4 mole) of magnesium glutamate, 480 g of water and 160 g of oil and dispersing agents such as defined in example 1. Composition VIII has an AV of 276.

Example 9

Preparation of composition IX from 28 g (0.7 mole) of magnesium oxide, 205.8 (1.4 mole) of glutamic acid, 663 g of water, then 221 g of oil and dispersing agents such as defined in example 1. After evaporating the water of the emulsion, the AV is 317.

Example 10

Composition X is prepared as previously mentioned from 24.8 g (0.65 mole) of magnesium oxide, 91.4 g (0.65 mole) of glutamic acid, 420 g of water, then 245 g of oil and dispersants such as defined in example 1. The AV of composition X is 240.

Tests of antiwear properties

The additive compositions described in examples 1 to 10 have been tested by FALEX tests according to the standard ASTM 2670 and by tests on ball machines according to the standard ASTM 2783-71 on oils of which the AV is brought to 70 by dilution with a pure mineral oil. The main results are grouped together in table I.

•FALEX tests: 900 lbs—3 h. The figure quoted is the number of teeth (the wear is that much lower as the number of teeth is smaller).

•4 ball wear tests: 1 800 t/mn—40 kg—30 mn—100° C. The figure quoted is obtained by determination of the diameter of the print.

TABLE 1

| Composition | FALEX Number of teeth after (H) ¼ | ½ | 1 | 2 | 3 | 4 balls print diameter (mn) |
|---|---|---|---|---|---|---|
| I | 9 | 12 | 26 | 64 | 81 | 0.44 |
| II | 8 | 12 | 42 | 138 | 231 | 0.49 |
| III | 0 | 0 | 0 | 8 | 44 | 0.40 |
| VIII | 5 | 5 | 5 | 8 | 11 | 0.44 |
| IX | 8 | 8 | 8 | 13 | 15 | 0.45 |
| X | 5 | 8 | 8 | 11 | 15 | 0.45 |
| IV | 25 | 46 | 55 | 100 | 130 | 0.62 |
| V (comparative) | 54 | 96 | 177 | 230 | rupture | 0.87 |

The products according to the invention present excellent anti-wear properties.

Mixtures with the dithiophosphates

Considerable synergistic values have been rendered apparent with respect to the antiwear properties when the compositions prepared according to the invention are used as additives in the lubricating compositions in the presence of other additives of the dithiophosphate type.

The test methods used are those described in the previous examples. The tests are performed on finished oils of AV 70 obtained by dilution of the compositions prepared according to Examples 1 to 10 by a pure mineral oil.*

*The antiwear tests results on the FALEX machine and 4 ball machine for:
an oil of AV 70 without additive,
an oil of AV 70 with dispersing agent,
the same with 20% of the microdispersion I,
the same with 0.3% of dithiophosphate of formula A, B or C,
the same with 20% of I+0.3% of A B or C are compiled in table 2.

TABLE 2

| | Basic oil | Base + dispersing agent | Base + dispersing agent + dithio 0.3% A | 0.3% B | 0.3% C | Base + composition I (20%) | Base + Composition I (20%) + dithio 0.3% A | 0.3% B | 0.3% C |
|---|---|---|---|---|---|---|---|---|---|
| FALEX 3 h 900 lbs | | | | | | | | | |
| ¼ h | rupture | rupture | 11 | 18 | 4 | 9 | 0 | 5 | 0 |
| ½ h | | | rup- | 34 | 13 | 12 | 4 | 9 | 0 |
| 1 h | | | ture | rup- | 27 | 26 | 9 | 10 | 3 |
| 1 h 30 | | | | ture | 47 | 49 | 9 | 10 | 3 |
| 2 h | | | | | 67 | 64 | 9 | 10 | 3 |
| 3 h | | | | | 77 | 81 | 10 | 14 | 3 |
| 4 Balls 1800 t/mn, 100° C., 30 mn, 80 kg | | | 2.1 | 1.78 | 1.82 | 1.14 | 0.92 | 0.7 | 0.82 |

Motor test

The antiwear properties have been tested on a PETTER AVI monocylinder according to the method DEF 2101 D. The tests have been performed on an oil of AV 40 containing the microdispersion I and an identical oil to which has been added 0.3% of dithiophospate. The results are compiled in table 3.

TABLE 3

| | Oil AV = 40 at 20% I | Oil AV = 40 at 20% I + 0.3% dithiophosphate A | B | C |
|---|---|---|---|---|
| Skirt | 10 | 10 | 10 | 10 |
| Belt | | | | |
| 1 | 6 | 8.4 | 9.7 | 9.7 |
| 2 | 8.2 | 8.8 | 9.5 | 9.4 |
| 3 | 8.3 | 8.4 | 9.7 | 8.9 |
| Average | 7.5 | 8.5 | 9.6 | 9.3 |
| Carbon Groove | | | | |
| 1 | 9.5 | 10 | 9.8 | 9.7 |
| 2 | 9.8 | 10 | 10 | 10 |
| 3 | 10 | 10 | 10 | 10 |
| 4 | 10 | 10 | 10 | 10 |
| Varnish groove | | | | |
| 1 | 0.7 | 6.6 | 6.2 | 5.4 |
| 2 | 2.1 | 7.5 | 9.6 | 9.2 |
| 3 | 7.5 | 9.5 | 10 | 9.9 |
| 4 | 9.2 | 10 | 10 | 9.9 |
| Average | 4.9 | 8.4 | 9 | 8.6 |
| Quotation | 6.2 | 8.45 | 9.3 | 8.95 |

We claim:

1. An additive for lubricating oils have an antirust and antiwear action comprising a Group I or Group II metal salt of an amino acid and a dispersing agent as a micro dispersion in an oil.

2. An additive according to claim 1, wherein the amino-acid is a dicarboxylic amino-acid selected from the group consisting of glutamic acid, aspartic acid, glutamine, asparagine and derivatives thereof.

3. An additive according to claim 1, wherein the amino-acid is a natural monocarboxylic amino acid selected from the group consisting of glycine, alanine, lysine, proline, arginine, serine, cystine and cysteine.

4. An additive according to claim 1, wherein the metallic salt is formed with an oxide or hydroxide of a metal from Group II of the Periodic Classification of Elements or a hydroxide from Group I.

5. An additive according to claim 4, wherein the metallic salt is obtained from calcium or magnesium oxides or hydroxides.

6. An additive according to claim 1, wherein the oil is a paraffinic or naphthenic mineral oil.

7. A process for preparing an additive according to claim 1, wherein a water-in-oil emulsion is formed by mixing together an aqueous solution of themetallic salt, saturated at ambient temperature, an oil and from a dispersing agent, the water present in the emulsion being than evaporated under stirring.

8. A process according to claim 7, wherein the oil is a paraffinic or naphthenic mineral oil.

9. A process according to claim 7, wherein the dispersing agent belongs to the group of succinimide or derivatives of alkylphenols.

10. A lubricating composition comprising a major part of lubricating oil and a minor quantity of at least one additive, wherein said additive is an additive according to claim 1.

11. A lubricating composition according to claim 10, wherein it contains from 1 to 30% by weight of additive.

12. A composition according to claim 10, which contains an additional anti-wear additive of the family of dithiophosphates selected from the group consisting of metallic dithiophosphates and amine dithiophosphates.

13. A composition according to claim 12, wherein the metallic dithiophosphate contains a metal selected from the group consisting of zinc and antimony.

* * * * *